US005388515A

United States Patent [19]

Schneider et al.

[11] Patent Number: 5,388,515

[45] Date of Patent: Feb. 14, 1995

[54] METHOD AND APPARATUS FOR PLACEMENT OF A DOCTOR BLADE AGAINST AN INK-DISPENSING ROLLER

[75] Inventors: Georg Schneider, Würzburg; Wolfgang O. Reder, Veitshöchheim; Dieter Reinhart, Hettstadt, all of Germany

[73] Assignee: Koenig & Bauer Aktiengesellschaft, Wurzburg, Germany

[21] Appl. No.: 51,933

[22] Filed: Apr. 26, 1993

[30] Foreign Application Priority Data

Apr. 25, 1992 [DE] Germany ..... 4213662

[51] Int. Cl.[6] ..... B41F 31/04

[52] U.S. Cl. ..... 101/363; 101/483

[58] Field of Search ..... 101/363, 364, 350, 169, 101/157, 365, 483, 207–210; 118/261

[56] References Cited

U.S. PATENT DOCUMENTS 3,593,663 7/1971 Vischulis ..... 101/157
4,463,675 8/1984 Ottenhues .
4,938,133 7/1990 Bock et al. .
5,168,806 12/1992 Reder et al. .

FOREIGN PATENT DOCUMENTS 289156 4/1971 Austria .
0053298 10/1981 European Pat. Off. .
0453910 4/1991 European Pat. Off. .
2538908 9/1975 Germany .
3832160 9/1988 Germany .

*Primary Examiner*—J. Reed Fisher
*Attorney, Agent, or Firm*—Jones, Tullar & Cooper

[57] ABSTRACT

A method and apparatus for placement of a doctor blade bar against an ink dispensing roller utilizes doctor blade supporting base bodies which have resiliently supported doctor blades and which are shiftable between rest and work positions along doctor blade base support beams by blade base shifting devices. The doctor blades are moved into engagement with the screen roller along a curved path. The resilient support of the doctor blades eliminates blade warping and possible damage to the working edge of the blades.

20 Claims, 9 Drawing Sheets

D
1
11
21
16
23
24
28
29
31
32
33
34
36
37
38
39
41
43
44
46
47
48
49
50
51
52
53
54
55
57
58
59
62
63
64
66
67
a

METHOD AND APPARATUS FOR PLACEMENT OF A DOCTOR BLADE AGAINST AN INK-DISPENSING ROLLER

FIELD OF THE INVENTION

The present invention is directed generally to a method and apparatus for the placement of a doctor blade bar against an ink dispensing roller. More particularly, the present invention is directed to a method and apparatus for placement of a doctor blade bar against an ink dispensing roller of a web-fed rotary printing press. Most specifically, the present invention is directed to a method and apparatus for placement of a doctor blade bar against an ink dispensing roller, such as a screen roller, of a web-fed rotary printing press. The method and apparatus of the present invention are usable to bring spaced, resiliently supported doctor blades of a short inking unit into contact with the surface of a screened ink roller or similar other roller in the printing press at a negative placement angle. Movement of doctor blade base bodies, which form a part of the doctor blade bar, is in a direction such that free ends of the doctor blades move toward or away from the surface of the screened ink roller.

DESCRIPTION OF THE PRIOR ART

Short inking units for use in web-fed rotary printing presses are generally known in the prior art. In these short inking units, it is conventional to utilize two spaced, axially extending doctor blades, in conjunction with spaced end plates, to form an ink receptacle or chamber. Ink is placed in this chamber and free ends of the doctor blades are brought into contact with the surface of an ink roller, which is frequently a screened surface ink roller. In such short inking units it is typically necessary to be able to bring the doctor blades into and out of contact with the surface of the screened ink roller and to be able to adjust the position of the doctor blades as well as to replace them when they become excessively worn.

Short inking units of the type which use chambered doctor blade assemblies frequently position the individual doctor blades in elongated slits or slots in doctor blade supporting base bodies which make up the doctor blade bar. This placement of the doctor blades in these slots facilitates the expeditious removal of worn doctor blades and their replacement with new blades. In chambered doctor blade assemblies which use a working or stripping-off blade and a closing or sealing blade, the wear is typically greater on the working or stripping off blade.

One prior art assembly is shown in German published unexamined patent application No. 25 38 908. In this prior art device there is disclosed the resilient support of a fast wearing doctor blade for a gravure printing press. In this arrangement the doctor blade is positioned generally vertically to the periphery of the cylinder to be inked. This type of an arrangement would not be usable in a short inking unit as part of a chambered doctor blade assembly. In these short inking units, the spaced doctor blades engage the surface of the screened ink roller at a negative angle of approximately 40° with respect to the tangent of the contact point of the working blade with the screen roller. If particularly thin, flexible doctor blades are brought into contact with the screened ink roller at a negative contact angle with an excessive amount of force during throw-on of the doctor blades or are bent as a result of an excessive preload, they will wear excessively. This excessive wear causes the doctor blades to have to be replaced too frequently and may also raise the greater question of whether the doctor blades can perform their function of being so-called stripping-off blades.

It will thus be seen that a need exists for a method and apparatus for the placement of a doctor blade against an ink dispensing roller of a web fed rotary printing press which overcomes the limitations of the prior art devices. The method and apparatus in accordance with the present invention overcome these limitations and are a significant improvement over the prior art devices.

SUMMARY OF THE INVENTION

It is an object of the present invention to provide a method and apparatus for placement of a doctor blade bar against an ink dispensing roller.

Another object of the present invention is to provide a method and apparatus for the placement of a doctor blade bar against an ink dispensing roller in a web-fed rotary printing press.

A further object of the present invention is to provide a method and apparatus for the placement of a doctor blade bar against an ink dispensing roller, such as a screen roller, in a web-fed rotary printing press.

Yet another object of the present invention is to provide a device for the placement of a doctor blade bar against an ink dispensing roller of a web-fed rotary printing press which is easy to manipulate.

Even a further object of the present invention is to provide a device for the placement of a doctor blade bar against an ink dispensing roller in which the doctor blade bar can be easily attached and placed against the ink-dispensing roller by simple means.

Still another object of the present invention is to provide a method and apparatus for increasing the service life of a blade in a chambered doctor blade which can be placed against an ink dispensing roller at a negative angle.

As will be discussed in greater detail in the description of the preferred embodiments which are set forth subsequently, the method and apparatus for placement of a doctor blade bar against an ink dispensing roller of a web-fed rotary printing press in accordance with the present invention utilizes doctor blade supporting base bodies which are slidably supported by doctor blade base support beams. These doctor blade base support beams also carry doctor blade base shifting devices which are actuable to move the base bodies to effect movement of the doctor blades into and out of contact with the screened ink roller. This movement of the base bodies by the base shifting devices is in a direction which moves the doctor blades toward and away from the screened ink roller in a direction which is generally in the plane of the blades so that the blades engage the screened ink roller at a negative angle. The doctor blades themselves are resiliently supported in the base bodies by suitable springs or other bearing assemblies. Wear indicators are provided as part of the doctor blade supporting assemblies so that the wear experienced by each individual doctor blade can be visually or otherwise monitored. The movement of the doctor blade supporting base bodies which make up the doctor blade bar is in a direction such that the free ends of the doctor blades initially contact the surface of the screen roller at a point other than their working position and then are pushed back into the doctor blade holders and move to their working positions. The appropriate negative contact angle between the doctor blades and the screen roller is reached by movement of the doctor blade supporting base bodies along the doctor blade base support beams.

Several significant advantages are provided by the method and apparatus for placement of a doctor blade bar against an ink dispensing roller of a web-fed rotary printing press in accordance with the present invention. The negatively placed doctor blades which are, for example, the working and sealing blades of a chambered doctor blade bar, or which could be only a single working blade, can be placed in contact with the ink-dispensing roller with very little force at a point away from their ultimate working point. As the doctor blade bar is then moved to position the two doctor blades in their working positions, the blades can be pushed against a selected resistance into the doctor blade holders. This allows doctor blades with a greater width to be used since a portion of the doctor blades will be disposed within the doctor blade holder and will only extend out from the holder to the extent needed to contact the surface of the screen roller or other ink-dispensing roller. This increased doctor blade width and the resilient support of the doctor blade increases its service life. These doctor blades which, in accordance with the present invention contact the surface of the screened ink roller at a negative angle have a service life that is several times greater than that of generally conventional doctor blades.

An additional advantage of the present invention is that by placing the doctor blades at a negative angle and by allowing them to be moved or forced back into the doctor blade holders, warping of the upper or working edges of the doctor blades is prevented to the greatest extent possible. This is particularly true when the working doctor blade is quite thin and flexible. The working doctor blade can be pushed or forced back into the doctor blade holder through a distance of, for example 4 to 10 mm. This amount or distance can be thought of, and used as an adjustment reserve.

The resilient placement of the working doctor blade in its associated doctor blade holder assures that the doctor blade will be automatically placed against the screen roller with the correct force as a result of the proper selection of the biasing force. Thus the service life of the doctor blades, and particularly of the working doctor blades will be increased. The wear of the blades can also be indicated. This allows the blades to be checked to see if the blade has been worn to a point at which no more blade adjustments are possible. Such a check can be made at any time merely by looking at the blade wear indicating assembly.

It will thus be seen that the method and apparatus for placement of a doctor blade against an ink-dispensing roller, such as a screened ink roller of a web-fed rotary printing press overcomes the limitations of the prior art devices and is a substantial advance in the art.

BRIEF DESCRIPTION OF THE DRAWINGS

While the novel features of the method and apparatus for placement of a doctor blade bar against an ink dispensing roller of a web-fed rotary printing press in accordance with the present invention are set forth with particularity in the appended claims, a full and complete understanding of the invention may be had by referring to the detailed description of the preferred embodiment which is presented subsequently, and as illustrated in the accompanying drawings, in which:

DESCRIPTION OF THE PREFERRED EMBODIMENT

Figure 1:
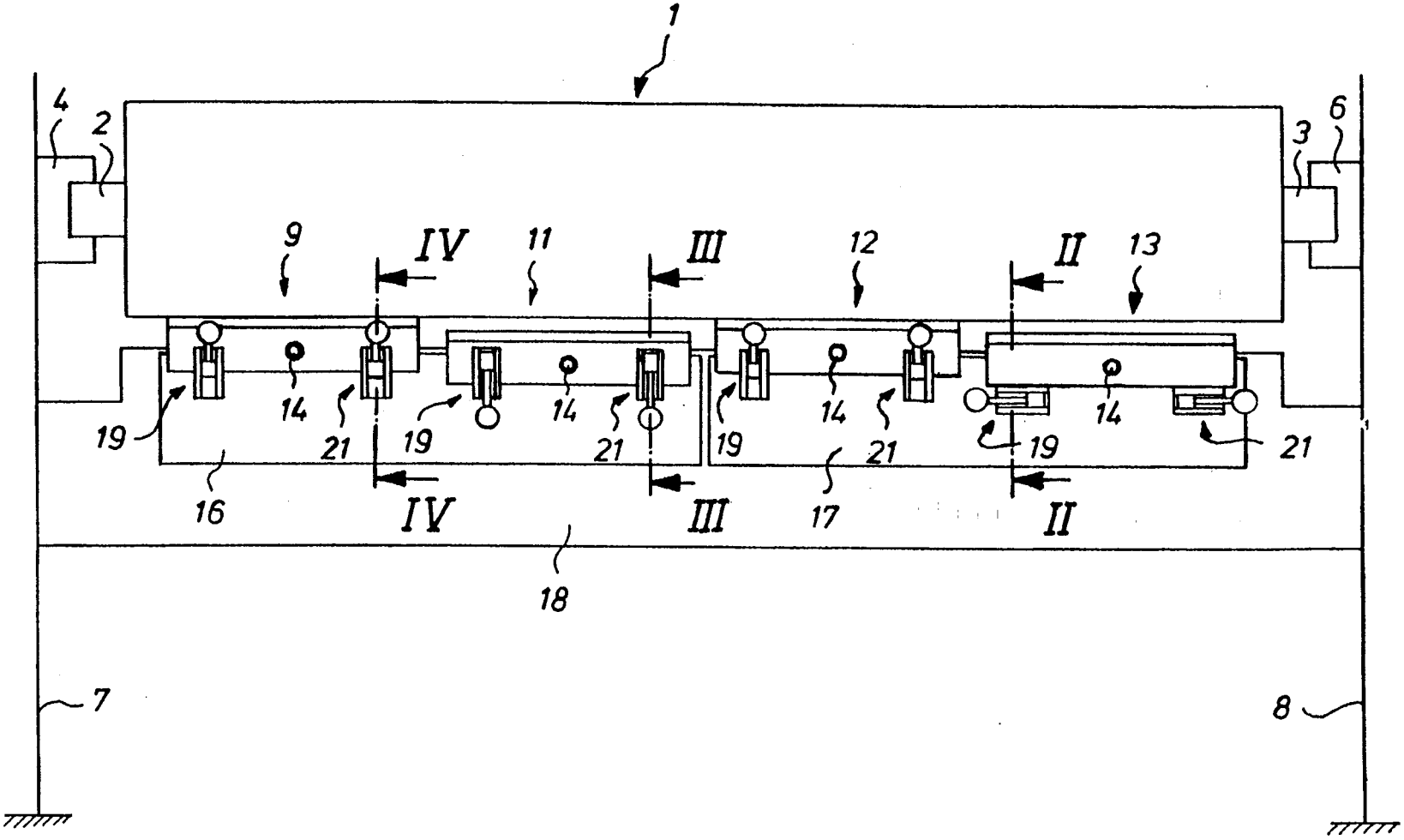
FIG. 1 is a front elevation view of a screen roller provided with four chambered doctor blades bars supported by the device in accordance with the present invention and showing the doctor blade bars disposed in several different positions.

Referring initially primarily to FIG. 1, there may be seen a preferred embodiment of a device for placement of doctor blade bars against an ink dispensing roller of a web-fed rotary printing press in accordance with the present invention. As may be seen in FIG. 1, there is provided an ink dispensing roller which is preferably in the form of a screen roller generally at 1. This screen roller 1 is rotatably supported between spaced side frames 7 and 8 by suitable axle journals 2 and 3. These axle journals 2 and 3 are supported in suitable cooperating bearings 4 and 6 that are secured on the side frames 7 and 8.

Figure 2:
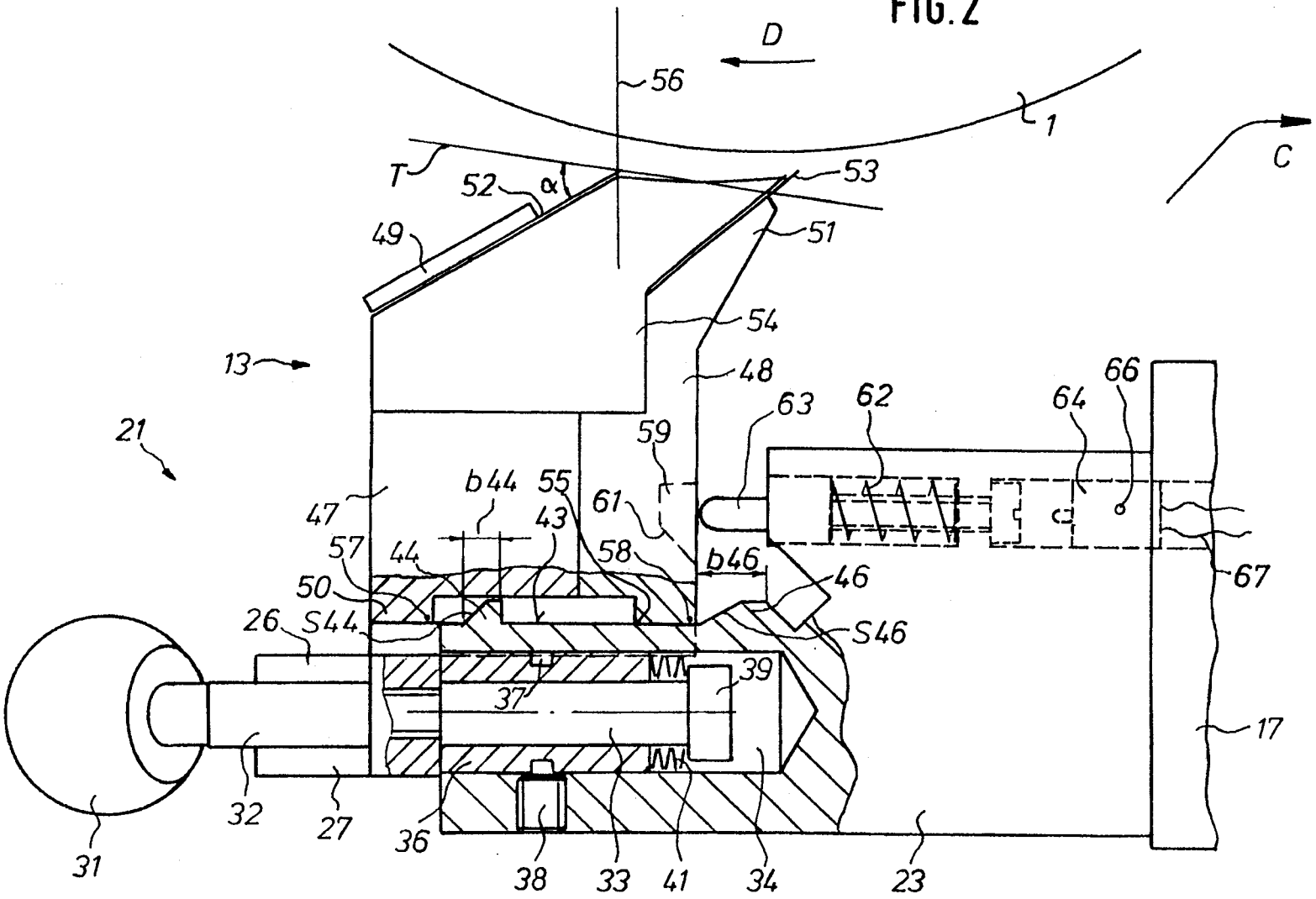
FIG. 2 is a side elevation view, partly in cross-section and taken along line II—II of FIG. 1 and showing a doctor blade bar assembly in a mounting position.
Figure 3:
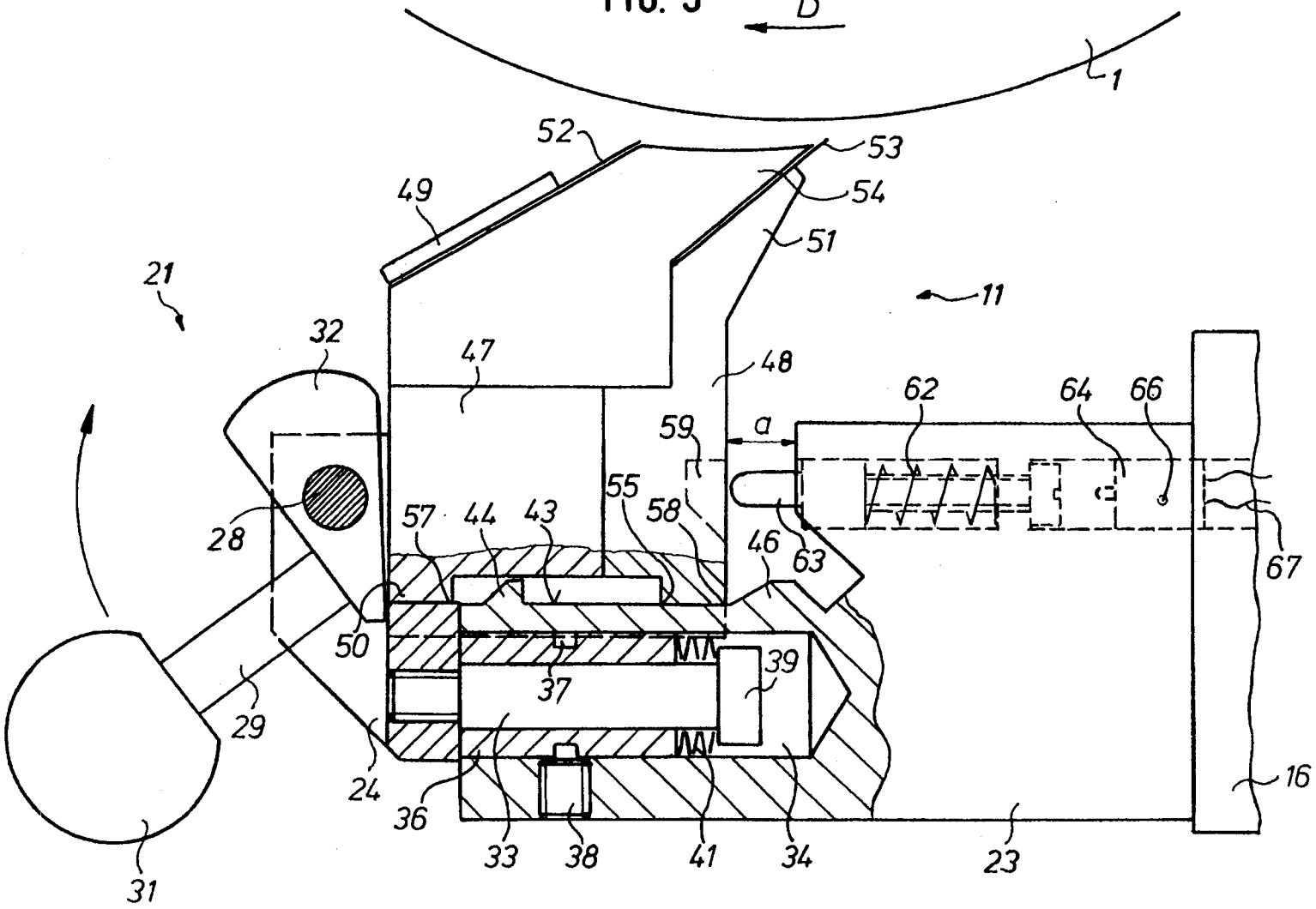
FIG. 3 is a side elevation view, partly in cross-section, taken along line III—III of FIG. 1 and showing a doctor blade bar assembly in a rest position.
Figure 4:
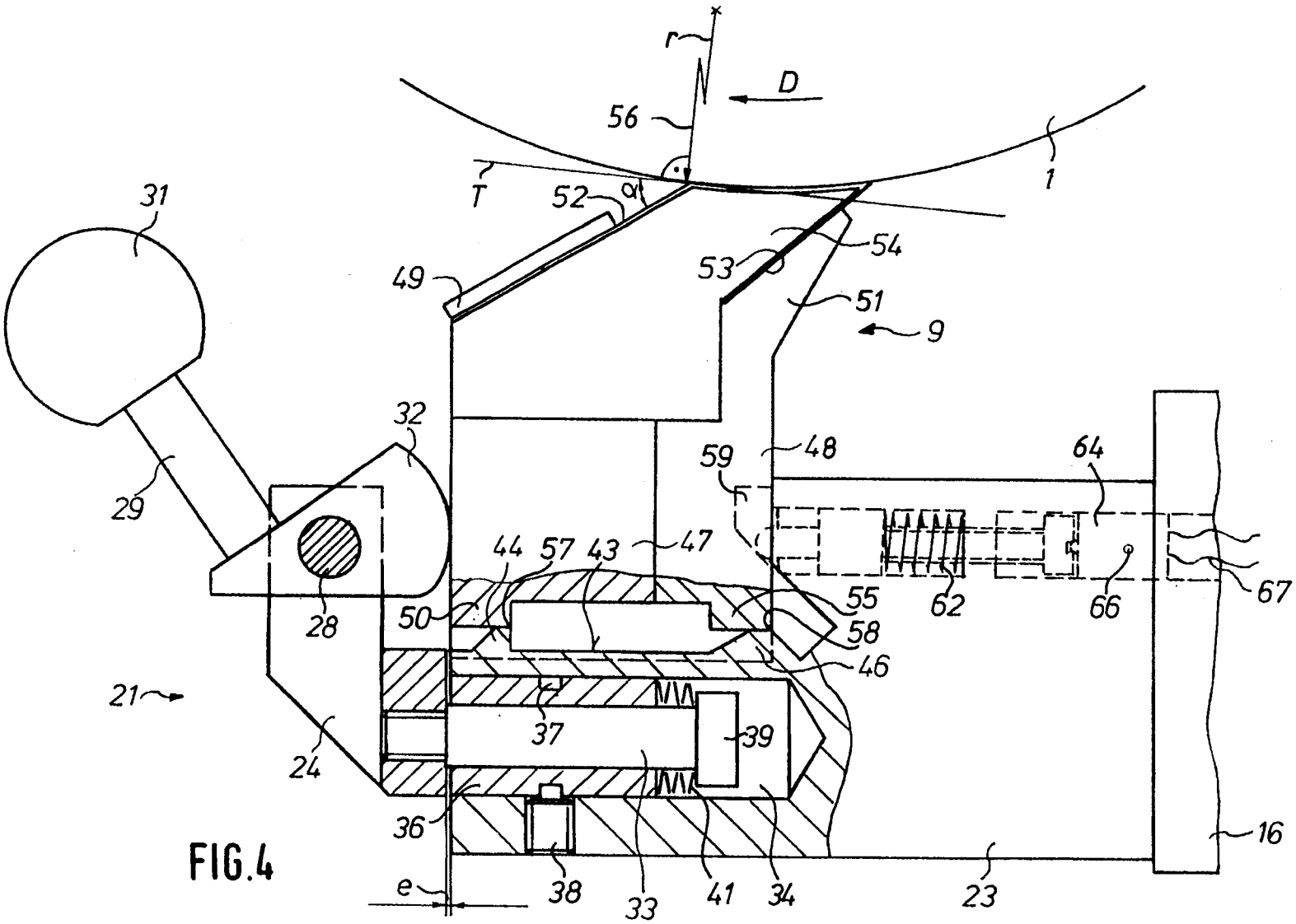
FIG. 4 is a side elevation view, partly in cross-section, taken along line IV—IV of FIG. 1, and showing a doctor blade bar assembly in a working position.

Four spaced, chambered doctor blade bars and their associated devices for use in placement of them against the screen roller 1 are shown generally at 9, 11, 12 and 13 in FIG. 1. These four doctor blade bars are located adjacent each other axially along the length of the screen roller 1 and are positioned generally beneath the screen roller 1, as shown in FIGS. 2, 3, and 4. In the depiction of the device in accordance with the present invention, as shown in FIG. 1, various ones of the doctor blade bars are shown in different positions. The doctor blade bar 13 is shown beneath the screen roller in its mounting position. The doctor blade bars 9 and 12 are shown in their working positions, and the doctor blade bar 11 is shown in its rest position. It will be understood that each of these doctor blade bars is positionable in each of its three positions; mounting, working or resting and that the depiction of specific ones of these doctor blade bars in certain positions is for purposes of illustration only.

Each of the doctor blade bars 9, 11, 12 and 13 is provided with an ink supply connection 14 which is connected by a suitable flexible line that is not specifically shown, to an ink pump. The ink pumps for the four axially spaced doctor blade bars 9, 11, 12 and 13 are also not specifically shown in the drawings. Each doctor blade bar 9, 11, 12 and 13 is also provided with an ink reservoir which, again, is not specifically shown. Each such ink reservoir can be formed in a generally funnel shape and can be placed beneath its associated doctor blade bar. In this way, each ink reservoir will be usable as a catch reservoir for the ink which is removed from the screened ink roller i by the associated doctor blade assembly.

The two adjacent doctor blade bars 9 and 11 are received in a first holder 16 while the two adjacent doctor blade bars 12 and 13 are received in a second holder 17. These two holders 16 and 17 are, in turn, secured on a crossbar or crossbeam 18 that is located between the spaced side frames 7 and 8. Each of these holders 16 and 17 has four spaced doctor blade bar locking and placement devices, or doctor blade base shifting devices, generally at 19 and 21 with two such doctor blade base shifting devices 19 and 21 being associated with each separate doctor blade bar 9, 11, 12 and 13.

Figure 5:
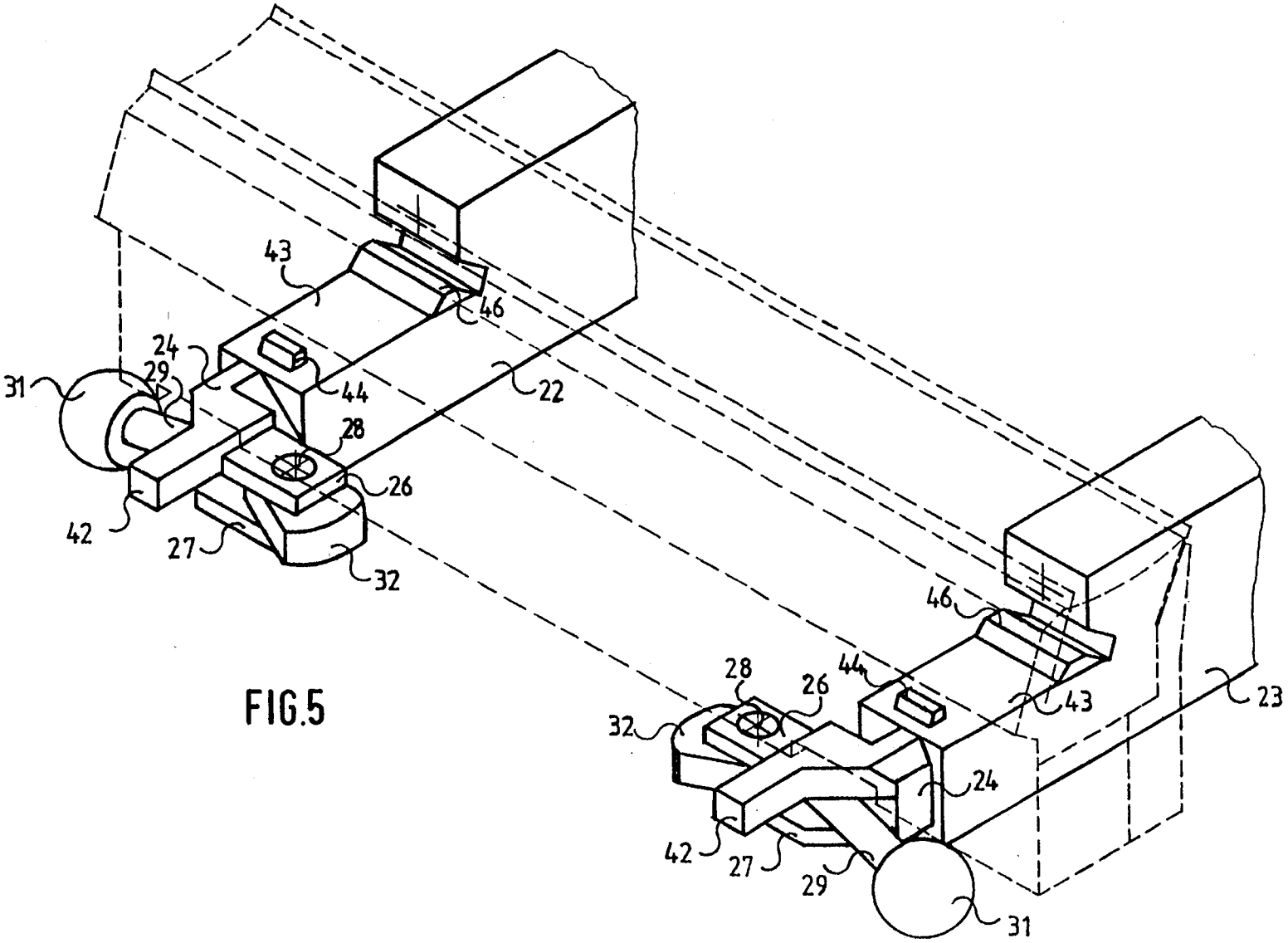
FIG. 5 is a perspective view of a pair of doctor blade base support beams and showing the doctor blade base shifting devices in the mounting position.

Spaced doctor blade base support beams, generally at 22 and 23, as seen in FIGS. 2–6 and most clearly in FIG. 5 are used to support the doctor blade bars. While the ink dispensing roller 1 will be discussed subsequently, as a screen roller, it will be understood that it would also be possible to utilize a different ink-dispensing roller in place of the screen roller 1.

Referring now to FIGS. 2–6, it will be seen that each doctor blade bar locking and placement assembly 19 and 21 or doctor blade base shifting assembly 19 or 21 utilizes a somewhat L-shaped body 24 that has a lower end and spaced angled, fork-shaped upper ends 26 and 27. An axially extending shaft 28 extends between these two fork-shaped ends 26 and 27 generally parallel to the axis of rotation of screened ink roller 1. A lever 29 has a ball handle 31 at a first end and an eccentric cam surface 32 is formed on the second end of the lever 29. The lever 29 is rotatably supported by a bore in the eccentric 32 which is carried by the shaft 28. The two doctor blade base shifting assemblies 19 and 21 which are used for the support and positioning of one of the doctor blade bars are shown in FIG. 5. In the rest of FIGS. 2, 3, 4 and 6 only one of the shifting assemblies 19 or 21 is shown. It will be understood that these shifting assemblies 19 and 21 are operable as pairs.

Figure 6:
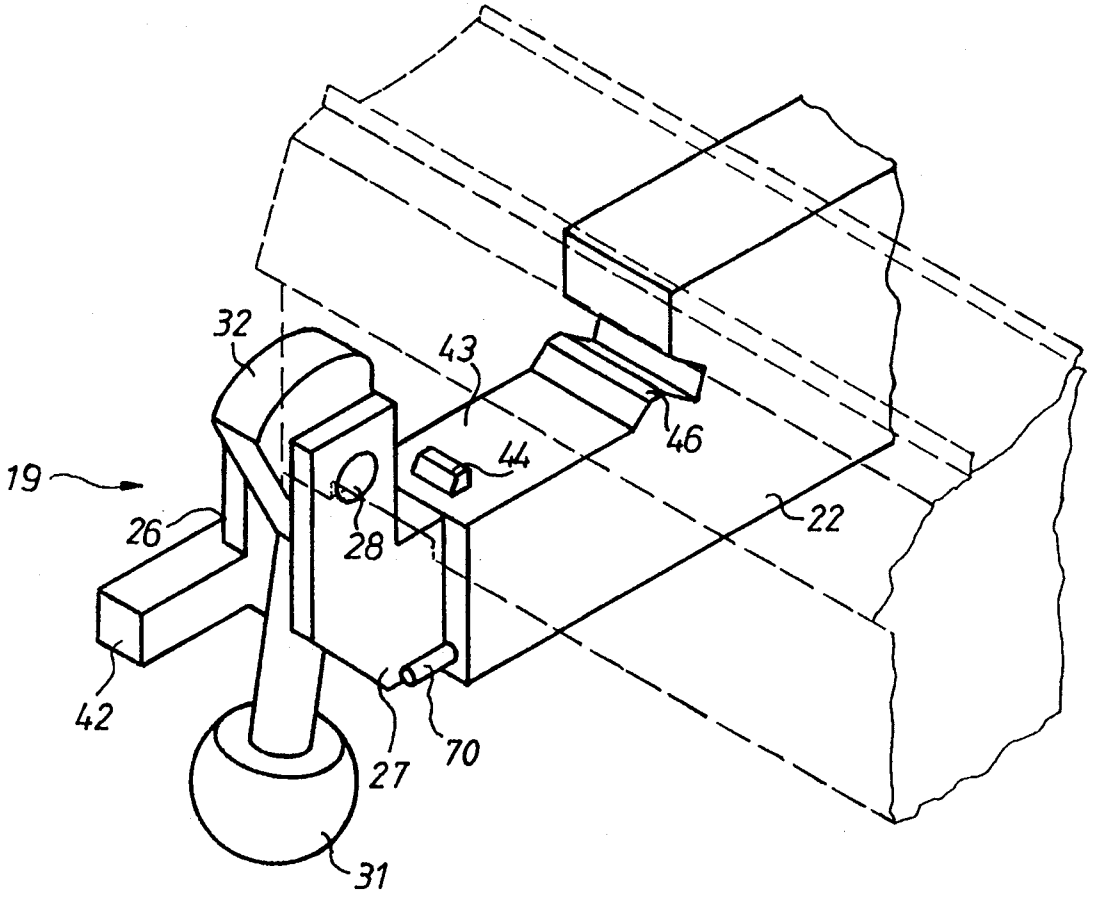
FIG. 6 is a perspective view of a single doctor blade base support beam and showing the doctor blade base shifting device in the rest position.

Turning now primarily to FIGS. 2, 3 and 4, each generally L-shaped body 24 of each of the doctor blade base shifting assemblies 19 and 21 is generally the same. Each body 24 includes a guide rail 42, as seen in FIGS. 5 and 6, which will be discussed in detail subsequently. A first, lower end of the body 24 is provided with a tapped bore hole that receives a threaded end of a set screw or dowel screw 33. This set screw 33 is positionable in a bore hole 34 that is formed in a free end of the doctor blade base support beam 23 with the pocket bore hole 34 extending generally parallel to a guide surface 43 of the beam 23. The set screw 33 carries an elongated sleeve 36 whose external outer diameter corresponds to the inside diameter of the pocket borehole 34. The sleeve 36 has a circumferential groove 37 extending completely around it intermediate its ends. A clamping screw 38 is screwed into a threaded bore in the bottom portion of the beam 23 and an inner end of clamping screw 38 is receivable in the groove 37 to hold the sleeve 36 in the pocket bore hole 34. A plurality of cup springs or Belleville washers or the like, generally at 41, are placed between an inner end of sleeve 36 and an enlarged head 39 of the set screw 33. The threaded end of the set screw 33 is passed through the cup springs 41 and the sleeve 36 and is screwed into the threaded bore in the first end of the L-shaped body 24 of the blade base shifting assembly 21. The sleeve 36 is then placed in the pocket borehole 34 and is held so that it cannot move axially in borehole 34 by the clamp screw 38. It will be noted that the cup springs 41 allow some axial movement of the set screw 33 in the sleeve 36 and that the clamp or locking screw 38 allows the sleeve 36 to turn while in the pocket bore 34. The exterior of the sleeve 36 may have external threads and the borehole 34 may be internally threaded.

Each end of each of the four doctor blade bars 9, 11, 12 and 13 is supported for sliding movement by one of the spaced doctor blade base support beams 22 and 23, as shown most clearly in FIG. 5. In FIGS. 2, 3 and 4, only one of these doctor blade base support beams 23 for each doctor blade bar 9, 11, 12 or 13 is shown. However, it will be understood that these support beams 22 and 23 are provided in pairs. Each doctor blade base support beam 22 or 23 is secured at a first end to one of the holders 16 or 17. The beams 22 and 23 extend in cantilever fashion away from the holders 16 or 17 and beneath the screened ink roller 1. The support beams 22 and 23 are generally perpendicular to the axis of rotation of the screened ink roller 1. A sliding cooperation between doctor blade supporting base body members 47 and 48 and each base support beam 18 or 19 is provided. An upper surface of each of the base support beams 22 or 23 is provided with a guide surface 43 upon which the base body members 47 and 48 are slidably supported for movement toward and away from the first end of the blade base support beams 22 and 23. First and second spaced, transverse lifting strips or cam surfaces 44 and 46 are formed on each blade base support beam 22 or 23. Both strips or cam members 44 and 46 have wedge-shaped cross sections, and the same height. However, as may be seen most clearly in FIG. 2, they have different widths, b44 and b46 so that they have different camming or lateral surfaces 72 and 73 with different ascending gradients or slopes s44 and s46. In the preferred embodiment of the apparatus for placement of a doctor blade bar against an ink dispensing roller in accordance with the present invention, the ascending gradient or slope of the cam member 44 is greater than the slope of the cam member 46. Thus s44 $>$s46 and b44 $<$b46. This difference in the slopes of the camming surfaces allows the doctor blade bar and its associated doctor blades to follow a somewhat arcuate or curved path during throw-on or throw-off of the doctor blades. This arcuate path to some extend follows the curvature of the screen roller 1 and reduces the clearance space required between the doctor blades and the screen roller to effect throw-on or throw-off of the blades.

Figure 7:
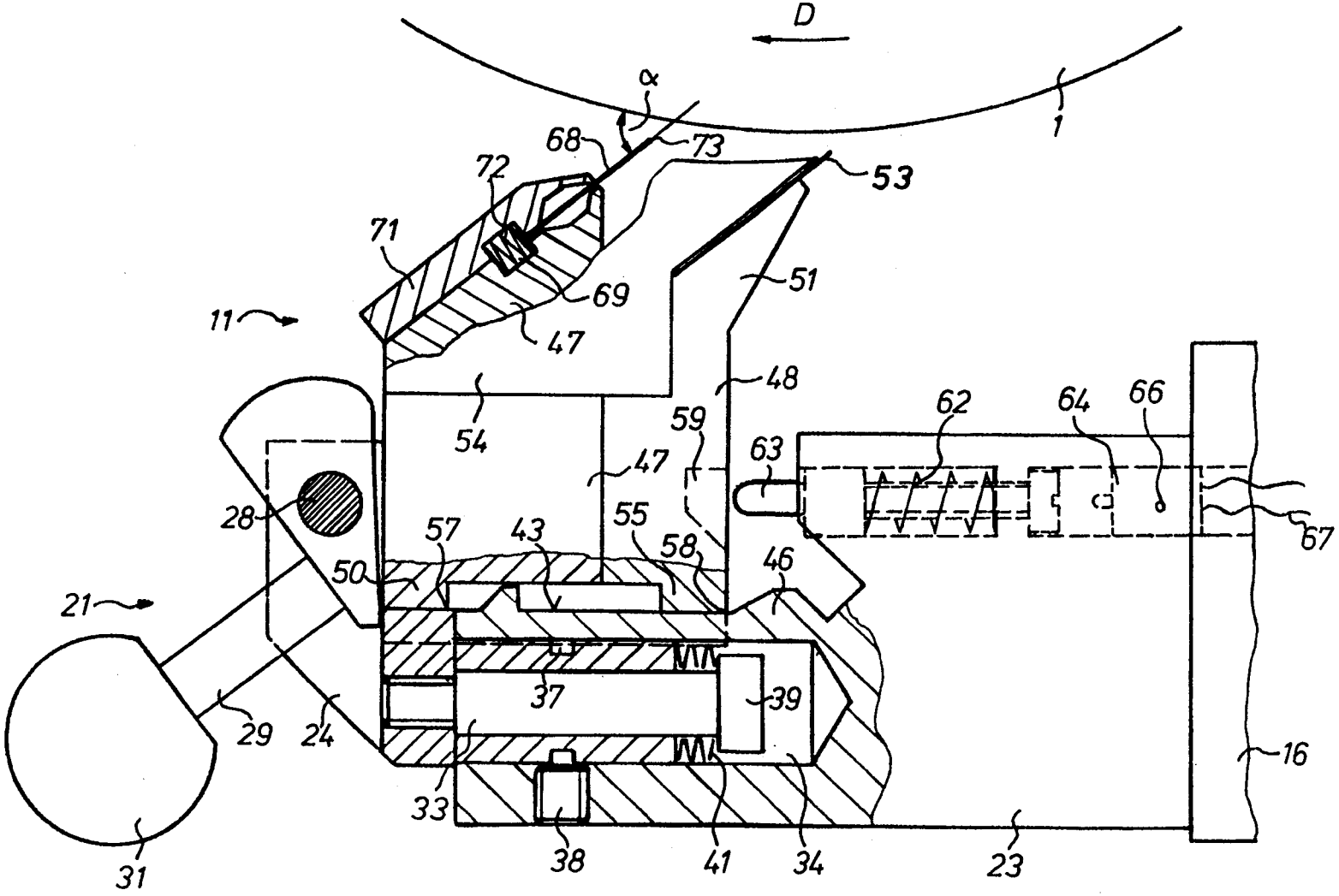
FIG. 7 is a side elevation view, partly in cross-section, and generally similar to the view shown in FIG. 3 and showing the resilient chambered doctor blade in a blade holder.
Figure 8:
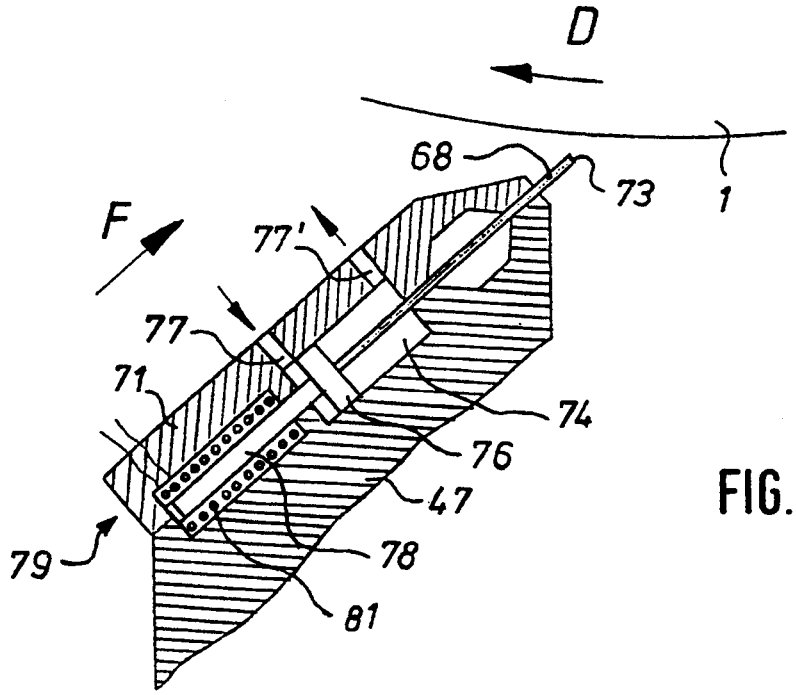
FIG. 8 is an enlarged detail view of a doctor blade holder and showing an adjustable working blade in a rest position.

Referring again primarily to FIGS. 2, 3 and 4, each doctor blade bar 9, 11, 12 and 13 consists of a two piece base body having the first and second doctor blade supporting base body members 47 and 48. These base body members 47 and 48 of each doctor blade bar 9, 11, 12 and 13 extend parallel to the axis of rotation of the screen roller 1 between their associated spaced doctor blade base support beams 22 and 23. The first doctor blade base body member resiliently supports a working or stripping-off doctor blade 52 in a first doctor blade holder 49. The second doctor blade base body member 48 supports a closing or sealing doctor blade 53 in a doctor blade holder 51. Closing or end plates 54 are disposed at the axial ends of the two doctor blades 52 and 53 and cooperate with them to form the ink chamber of the doctor blade. This ink chamber has an open upper portion so that the screen roller 1 can have its surface in contact with the reservoir of ink in the ink chamber of the doctor blade. As the screen roller moves in the direction indicated by arrow D in FIGS. 2, 3, and 4, the ink in the reservoir will be applied to the screen roller 1. The working or stripping-off blade 52 is resiliently seated in the blade holder 49 in a manner which is also shown in FIGS. 7 and 8 and which will be discussed in detail subsequently.

Again referring primarily to FIGS. 2, 3 and 4, each of the base body members 47 and 48 has a pair of spaced counter strips or cam followers 50 and 55, with leading edges 57 and 58. These counter strips or cam followers 50 and 55 slide along the upper surface 43 of the two spaced doctor blade base support beams 22 and 23 upon actuation of the eccentrics 32 and cause the doctor blade support base body members 47 and 48 move in the direction indicated by arrow C in FIG. 2. The leading edges 57 and 58 of the counter strips 50 and 55 ride up the cam surfaces or lifting strips 44 and 46 as each doctor blade bar 9, 11, 12 or 13 is moved between the rest position shown in FIG. 3 and the work position shown in FIG. 4. These leading edges 57 and 58 could also be angled and could have the same ascending gradients, s44 and s 46 as their cooperating strips or cam surfaces 44 or 46.

As may be seen in FIGS. 2, 3 and 4, the base body member 48 has an indexing indentation on its surface closest to the bar 16 or 17. This indexing indentation is in the form of a pocket or blind hole 59 that has a chamfered lower surface 61. This chamfered lower surface 61 slopes downwardly toward the upper end of an edge 58 on the base body member 48. Referring again to FIGS. 2, 3 and 4, a borehole is formed in each of the doctor blade base support beams 22 and 23 with this borehole being generally parallel to the pocket borehole 32 and extending from the first end of each of the beams 22 and 23 to a point adjacent the pocket hole 59 in the base body member 48. A pressure piece 63 is supported in this borehole and extends out from the beam toward the base body member 48. A spring 62 is utilized in the borehole to bias the pressure piece 63 out of the beam. As may be seen in FIG. 4, when the blade base shifting assembly 21 is used to move the base body members 47 and 48 to the right, in the direction shown by arrow C in FIG. 2, to thereby engage the free ends of the doctor blades 52 and 53, respectively, with the surface of the screened ink roller 1, the pressure piece 63 will be forced into its borehole by the chamfered edge 61 of the pocket hole 59 in the base body member 48 and will engage a suitable limit switch 64. The limit switch 64, in turn engages a contact piece 66 which is connected through suitable wires or cables 67 with the ink pump that will supply ink to the ink chamber defined by the doctor blades 52 and 53 and the end or closing plates 54. Thus when the doctor blade bar assembly is in the position shown in FIG. 4, the depression of the contact piece 63 will cause ink to be delivered to the ink chamber. When the doctor blade bar assembly is in the thrown-off position shown in FIG. 3, the ink pump will be deactivated and no ink will be supplied to the ink chamber.

In operation, the doctor blade bar assembly, in accordance with the present invention, is usable to move the doctor blades 52 and 53 into, or out of engagement with the screened ink roller 1 and also to be removed. In removal of the doctor blades 52 and 53 to change or clean them, the L-shaped bodies 24 of the base shifting assemblies 19 and 21 can be rotated through 90° by pushing laterally on the ball handle 31 of the lever 29 since the bodies 24 will rotate with sleeves 36 turning in the pocket boreholes 34. The L-shaped bodies 24, once they have been rotated 90° as is shown in FIGS. 2 and 5, will form a horizontal plane that includes guide rails 42 and is a continuation of the guide surfaces 43 of the doctor blade base support beams 22 and 23. The doctor blade base body members 47 and 48 can be slid out along this horizontal plane, as shown in FIG. 2. The doctor blade bar 13 can be moved out on the two guide rails 42 which are shown in FIG. 5 until the end of the first blade base support bodies 47 rest against the ball handles 31. Thus only a small space is needed to manipulate the doctor blade bars 9, 11, 12 and 13.

When it is necessary to move the doctor blade base body members 47 and 48 and hence their associated doctor blades 52 and 53, respectively from their work position shown in FIG. 4 to their thrown-off or rest position shown in FIG. 3, the ball handles 31 of the levers 29 will be grasped and the lever pulled downwardly to the position shown in FIG. 3. This will rotate the cam body or eccentric 32 with the shaft 28. Such rotation of the cam body will cause the eccentric cam surface 32 to disengage an outer face of the base body member 47. This causes the base body member 47 and its associated base body member 48 to move to the left along support surface 43. Since the eccentric 32 is no longer in contact with the face of the base body member 47, the doctor blade bar will be in its rest position, as shown in FIG. 3. In this position, the springs or washers 41 will cause a space "a" to be formed between the doctor blade bar base support beam 23 and the doctor blade base body 48 wherein the edge portions 57 and 58 of the cam followers move out of engagement with the lifting strips or cams 44 and 46 and are again supported on the surfaces 43 of the doctor blade base support beams 22 and 23. In this position, as seen in FIG. 3, the pressure piece 63 is not in contact with the switching depression 59 so that the limit switch 64 will have turned off the ink supply. This operation can be reversed to move the doctor blade bars from their rest positions back to their work positions.

In the work position of the doctor blade bar 9 depicted in FIG. 4, the spacing or distance "e" is the value of the prestressing of the plate springs or washers 41 with which the doctor blade bars 9, 11, 12 and 13 are clamped. The working doctor blade is placed against the screen roller 1 at an angle $\alpha$ in relation to the perpendicular line 56 of the tangent line T which is drawn at the point of contact of the end of the working doctor blade with the screen roller 1, as seen in FIG. 4. The perpendicular line 56 corresponds to the radius y of the screen roller 1.

As may be seen in FIG. 6, a stop 70 is provided on the lower outer portion of the free end of the doctor blade base support beam 22. A similar stop is provided on the second doctor blade base support beam 23 for each of the doctor blade bars 9, 11, 12 and 13. These stops are used to limit the rotation of the generally L-shaped bodies 24 of the doctor blade base shifting devices 19 and 21 so that they cannot rotate more than 90° into the positions shown in FIG. 5. Further rotation of bodies 24 would disturb the horizontal support surfaces depicted in FIG. 5.

It will be understood that other devices could be used instead of the eccentrics 32 and plate springs 41 to effect clamping of the doctor blade bars. For example, pneumatic work cylinders could be utilized.

Turning now to FIG. 7 which is generally the same as the section III—III of FIG. 1 there is shown a doctor blade bar, generally at 11 which has a working or stripping-off doctor blade 68 which is resiliently supported in a doctor blade bar holder 71 which is secured to the base body member 47. Cooperatively placed, axially extending grooves are formed in the doctor blade holder 71 and in the base body 47 with these grooves defining an axially extending channel 69 into which the inner end of the working doctor blade 68 is placed. A plurality of springs 72 are disposed in this channel 69. These springs 72 bias the working doctor blade 68 outwardly toward the screen roller 1 so that a working outer edge 73 of the working doctor blade 68 will be pushed into engagement with the screen roller 1 as the doctor blade supporting base bodies 47 and 48 are moved along the base support beams 22 and 23 in the direction indicated by the arrow C in FIG. 1. The springs 72 placed in the channel 69 can be, for example, helical springs or leaf springs. It will be understood that the inner end of the doctor blade 68 will have an enlarged portion or other suitable structure to keep it in the channel 69.

Referring now to FIG. 8, a second embodiment of an adjustable working blade 68 in accordance with the present invention is shown in detail. In FIG. 8, the working blade 68 is shown in a rest position in which it does not contact a peripheral surface of screen roller 1. The working blade 68 of this embodiment has an inner end which is received in a channel 74 formed by cooperating grooves in the blade holder 71 and the base body 47. The inner end of the doctor blade 68 rests against the top of a piston 76 which is movable in the channel 74 in the direction of arrow F. The channel 74 has one or more supply conduits or passages 77 through which oil, hydraulic fluid, compressed air or the like can be supplied at a desired pressure level. This pressurized fluid is used as the medium for the actuation of the piston 76 so that an even pressure is applied to the bottom of the piston 76. Any suitable pressure generator and pressure control assembly may be used to provide the fluid under pressure and to control its application to the lower surface of the piston 76. The amount of pressure supplied to the piston 76 will determine the amount of force which is applied to the blade 68 to push its end 73 into contact with the screen roller 1. The wear indication shown in FIG. 8 is also usable with a closing or sealing blade.

An elongated piston guide rod 78 extends downwardly from the lower face of the piston 76 and is received in a slot between the doctor blade holder 71 and the base body 47. This piston guide 78 is provided with a wear indicator 79 that may include an electrical coil 81 or an inductive displacement transducer. This coil or transducer is also placed in the slot between the blade holder 71 and the base body 47. The core of this coil is formed by the end of the piston guide 78. The position of the piston guide 78 in the coil or transducer 81 is indicative of the position of the end 73 of the doctor blade 68.

As the working end 73 of the doctor blade 68 wears down, the fluid pressure force applied to the piston 76 will constantly urge the working doctor blade 68 toward the screen roller 1 so that appropriate contact between the doctor blade 73 and the roller 1 will be maintained. As the piston 76 reaches the upper end of the channel 74 while it moves in the direction indicated by arrow F, with the distance of travel of piston 76 being generally 4–10 mm, the end of the ferromagnetic piston guide 78 will exit the coil 81 so that the magnetic flux will change and will thereby provide an indicator of the wearing out of the doctor blade 68. The exiting of the piston guide 78 from the coil 81 can be indicated by a signal generated thereby being displayed in a press control room. Alternatively, the wear indicator 79 can be designed in such a way that the lower end of it will extend out of the doctor blade bar 11 to provide a visual indicator of blade wear, such as by use of a visually readable graduation or scale, as will be discussed subsequently.

Figure 9:
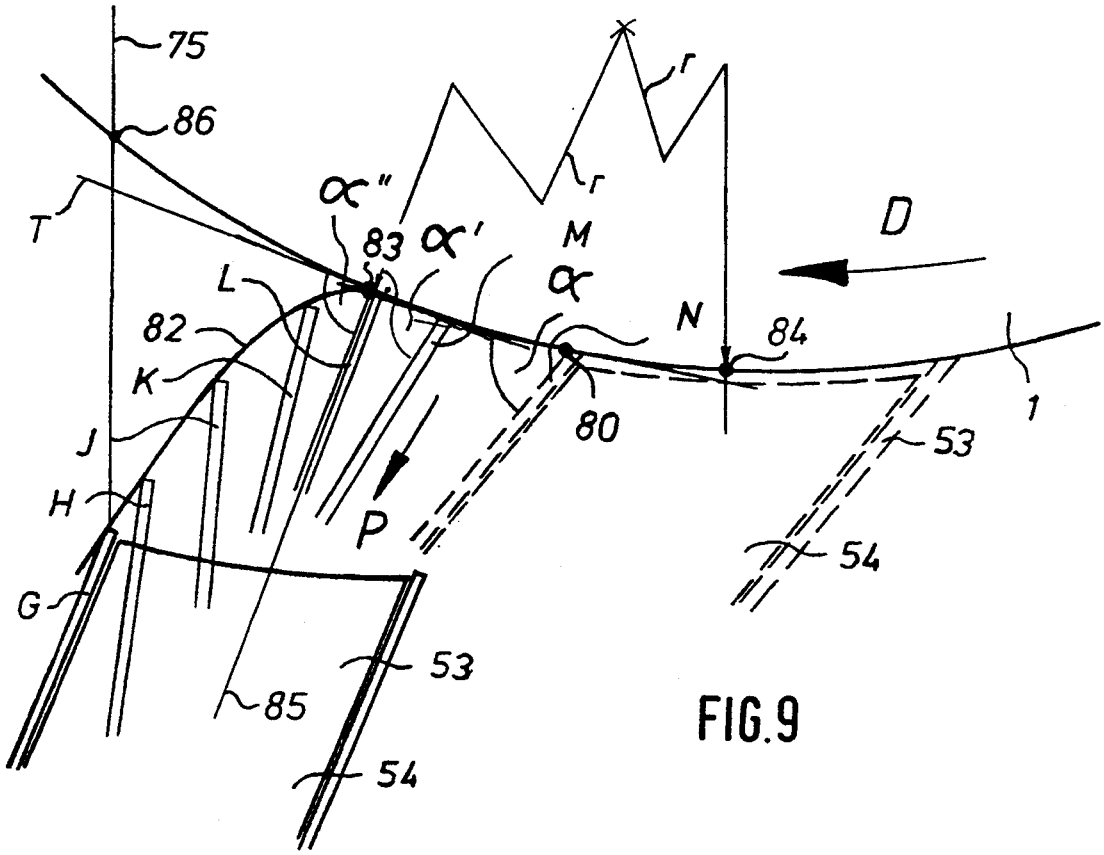
FIG. 9 is a schematic depiction of the path of travel of a working edge of a resiliently supported working doctor blade when it is placed against a screen roller.

Referring now to FIG. 9, there is somewhat schematically depicted the path of travel of the working or leading edge 73 of the working or stripping-off doctor blade 68 during movement of the doctor blade bar from its rest position toward the working position, i.e. into engagement with the screen roller 1. It will be understood that the schematic depiction shown in FIG. 9 also shows the closing or sealing doctor blade 53 and the end or closing plate 54. The starting or rest position of the trailing end 73 of the working doctor blade 68 is indicated at G in FIG. 9. This is the rest position which is also shown in FIGS. 3, 7, and 8.

As the ball handles 31 are moved upwardly, the doctor blade bar 11 is caused to move generally in the direction indicated by the arrow C in FIG. 1. This movement is caused by the movement of the transport edges 57 and 58 along the guide surface 43 and up the ribs 44 and 46. The free working edge 73 of the doctor blade 68 follows the curve shown in FIG. 9 from its starting or rest position at G through the intermediate positions starting at H to the final working positions indicated at N, which is the position against the screen roller 1. During the movement of the working edge 73 along this curve, the angle $\alpha$ of the working blade 68 in relation to the surface of the screen roller changes.

At the position along the curve indicated at L in FIG. 9, the working edge 73 of the working doctor blade 68 first contacts the surface of the screen roller 1. This contact point is indicated at the contact point 83 or the contact line T. At this point, the angle $\alpha$ between the working doctor blade 68 and the line T is generally 90°. As the doctor blade bar 11 moves oppositely to the direction of rotation of the screen roller 1; i.e. opposite to the direction of rotation indicated by the arrow D, to bring the working doctor blade 68 to its final working position at N, the angle $\alpha$ of the doctor blade 68 to the tangent T at the point of contact 80 will be generally about 40°. This contact point 80 is the closest that the working end 73 of the working doctor blade will approach the lowest point 84 of the screen ink roller 1. An intermediate position of the working doctor blade 68, as designated at M has an angle of approximately 60° to 70° with respect to the tangent line T.

As the doctor blade bar 11 is moved into its work position, generally in the direction indicated by the arrow C in FIG. 2, the working doctor blade 68 has its leading edge first contact the screen roller 1 at the point 83, as discussed above. After leaving this initial contact point 83, the working doctor blade then moves in the direction by the arrow P in FIG. 9 into the doctor blade holder and against the force of the spring 72 or the piston 76. At the same time, the doctor blade bar is moving in opposition to the direction of rotation of the screen roller, as is indicated by the arrow D, until the working doctor blade 68 arrives at its final work position N. This placement of the working edge 76 of the working doctor blade 68 against the surface of the screen ink roller 1 is accomplished without any bending of the working edge of the doctor blade. Continuous adjustment of the doctor blade 68 is accomplished automatically by the force of the spring 72 or the piston 76 as the leading edge 73 of the doctor blade is worn away. The end position N of the working doctor blade 68 corresponds to a doctor blade reserve position.

The curved path 82 which is defined by the travel of the working end 73 of the working or stripping-off doctor blade 68 during movement of the doctor blade tip 73 up to the contact point 83 has proved to be a particularly advantageous path of travel. This curve 82 corresponds to one arm of a parabola which has an axis of symmetry 85 that passes through the contact point 83 and the turning point of which is also located in the contact point 83.

It is also possible, in accordance with the present invention, to place the working doctor blade 68 with its leading working edge 73 against the screen roller 1 at a point of contact 86. This would be accomplished by moving the working blade 68 and the entire doctor blade bar 11 along the line 75. Once the working blade 68 has engaged the screen roller at the contact point 86, the doctor blade bar 11 is then again moved in the direction indicated by arrow C in FIG. 2 in the direction opposite to the rotation of the screen roller, as indicated by the arrow D in FIG. 9, to the working point 80 in the working position N. This path of travel is advantageous when it is necessary to position generally thick doctor blades.

It is also possible, in accordance with a further preferred embodiment of the subject invention to place the two doctor blade supporting base bodies 47 and 48 against the screened roller 1 separately. In this embodiment, the base body 48 which carries the closing doctor blade 53 remains in a position in which the blade 53 stays in contact with the screen roller 1; i.e. in which the base body 48 and the closing blade 53 are clampingly embodied. The base body 47 and its associated working doctor blade 52 can be placed against the screen roller 1 by way of the curved path 82 or 86. In this embodiment, the base body 48 will be connected to the closing or end plate 54. The base body 47 can be brought into position with respect to the base body 48 by way of transport edges, which correspond to the previously discussed transport edges 57 and 58, and the two base bodies can be joined to form a chambered doctor blade.

Figure 10:
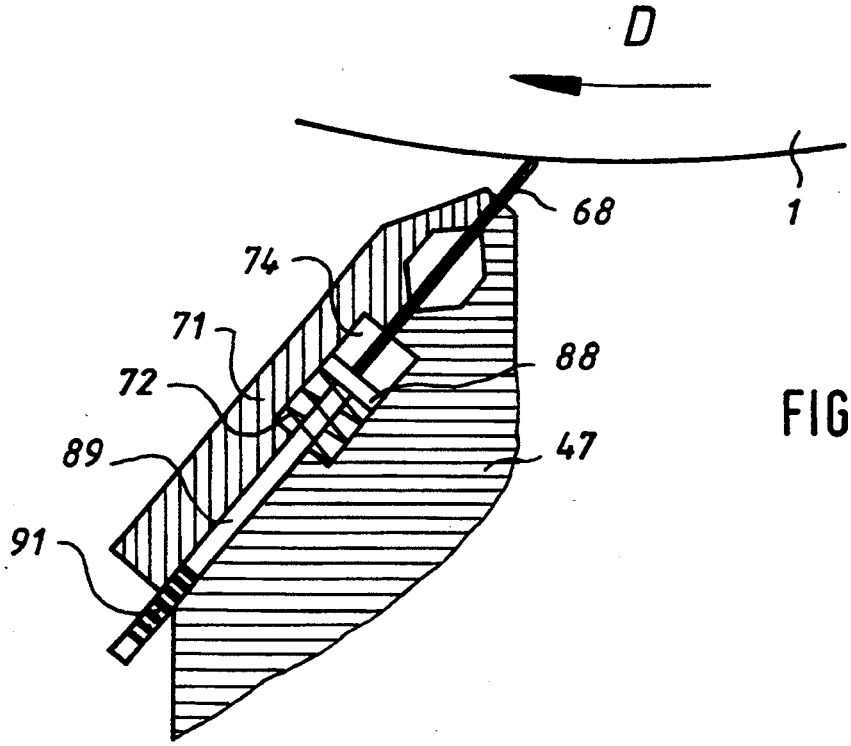
FIG. 10 is an enlarged detail view of a doctor blade holder and showing another embodiment of a resiliently supported doctor blade in position against a screen roller.

Turning now to FIG. 10, there is shown another preferred embodiment of a doctor blade holder and wear indicating assembly in accordance with the present invention. In this embodiment, the working blade 68 is supported in the blade holder 71 on the base body 47 by a first, upper side of a disk 88 that is situated in the channel 74. The disk 88 is biased outwardly by the spring assembly 72. The second, lower side of the disk 88 is connected with a piston guide rod 89 that extends downwardly through a channel or slot between the doctor blade holder 71 and the base body 47. A portion of the piston guide rod 89 projects out beyond the blade holder 71 and has a plurality of gradations 91 that are usable to visually ascertain the amount of wear of the doctor blade 68.

Figure 11:
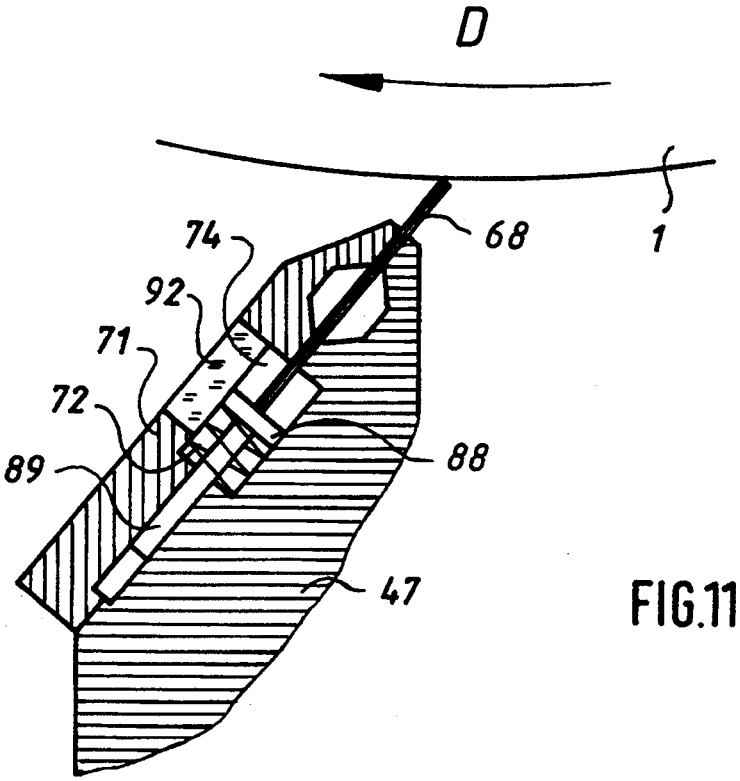
FIG. 11 is a view similar to FIGS. 8 and 10 showing another embodiment of a resiliently supported doctor blade with a wear indicator.

Another preferred embodiment of a doctor blade holder and wear indicator in accordance with the present invention is shown in FIG. 11 of the drawings. In this embodiment, the working doctor blade 68 is supported by the blade holder 71 and the base body 47 in the channel 74 by the disk 88 against the force of the spring 72. The doctor blade holder 71 has a window 92 which is covered with a transparent material, such as, for example, glass. The position of the disk 88 and thus the amount of wear of the working doctor blade 68 can be shown through the window 92.

In accordance with the present invention, the doctor blade bars 9, 11, 12 and 13 are preferably situated, as shown in FIG. 1 so that they will be brought into engagement with the screen roller 1 in an area of the screen roller which is located below the horizontal diameter of the screen roller 1. Further in accordance with the present invention the feet with the leading edges 57 and 58 of the counter strips 50 and 55 can be provided as laterally extending strips beneath the doctor blade bars 9, 11, 12 and 13 with these strips extending over the entire length of the doctor blade bars 9, 11, 12 and 13.

While preferred embodiments of a method and apparatus for placement of a doctor blade bar in accordance with the present invention have been set forth fully and completely hereinabove, it will be understood that a number of changes in, for example, the overall size of the screen roller, the number of doctor blade bars positioned beneath the screen roller, the type of bearings used to rotatably support the screen roller and the like may be made without departing from the true spirit and scope of the present invention which is accordingly to be limited only by the following claims.

We claim:

1. A method for placement of a doctor blade against an ink-dispensing roller in a web-fed rotary press, said method comprising:

providing at least a first doctor blade bar having at least a first doctor blade supporting base body;

resiliently supporting a first doctor blade in said doctor blade supporting base body;

moving said doctor blade along a first curved path of travel corresponding to one arm of a parabola toward an ink dispensing roller;

bringing a working edge of said doctor blade into linear contact against a surface of an ink dispensing roller at a contact point remote from a final working position of said doctor blade, said contact point being at an axis of symmetry of said parabola;

moving said doctor blade along a second path of travel along a jacket surface of an ink dispensing roller into said final working position; and pushing said doctor blade into said doctor blade supporting base body while moving said doctor blade along said second path of travel along a jacket surface into said doctor blade working position.

2. The method of claim 1 further including moving said doctor blade along a jacket of an ink-dispensing roller into said final working position in a direction opposing a direction of rotation of an ink-dispensing roller.

3. The method of claim 1 further including moving said doctor blade along a jacket of an ink-dispensing roller into said final working position in a direction the same as a direction of rotation of an ink-dispensing roller.

4. Apparatus for the placement of a doctor blade supported in a doctor blade bar against an ink dispensing roller in a web-fed rotary printing press, said apparatus comprising:

at least a first doctor blade supporting base body forming a doctor blade bar;

at least a first doctor blade resiliently supported in said doctor blade bar at a negative placement angle with respect to an ink-dispensing roller;

means to move said doctor blade bar initially along a first curved path of travel which correspond to one arm of a parabola until a working end of said first doctor blade engages a jacket of an ink-dispensing roller at a first angle at a contact point which is on an axis of symmetry of said parabola, and is pushed back into said doctor blade bar against a force of a biasing means, said first angle being generally perpendicular to a tangent line at said contact point of said working end of said first doctor blade with a jacket of an ink-dispensing roller, and to subsequently move said doctor blade bar along a second path of travel generally along a jacket of an ink-dispensing roller to a working position of said doctor blade wherein said doctor blade is at a negative placement angle with regard to said tangent line;

transport edges provided on first portions of said doctor blade bar; and doctor blade base support beams having first and second ribs which are engageable with said transport edges when said doctor blade bar is moved by said means to initially and subsequently move said doctor blade bar.

5. The apparatus of claim 4 wherein said means to move said doctor blade bar includes a blade base shifting assembly secured to each of said doctor blade base support beams.

6. The apparatus of claim 5 wherein said blade base shifting assembly has a rotatable body with two angled, fork-shaped ends and wherein said rotatable body is rotatably seated in said doctor blade bar support beams by a dowel screw.

7. The apparatus of claim 6 wherein said dowel screw is disposed in a blind bore in said doctor blade bar support beam and is enclosed in a sleeve having an exterior diameter which corresponds to said blind bore.

8. The apparatus of claim 7 wherein said sleeve has an annular groove at its circumference which is engaged by an end of a locking screw secured in said doctor blade support beam.

9. The apparatus of claim 7 further including plate springs disposed between a head of said dowel screw and a front end of said sleeve.

10. The apparatus of claim 6 further including a shaft disposed between said fork-shaped ends and which supports a lever having a ball handle on a first end and an eccentric on a second end.

11. The apparatus of claim 10 wherein said lever is pivotably seated on said shaft through a bore in said eccentric.

12. The apparatus of claim 10 wherein said eccentric is in functional contact with said base body of said doctor blade bar.

13. The apparatus of claim 6 wherein said rotatable body has a guide rail extending in an axial direction of said dowel screw.

14. The apparatus of claim 6 wherein rotational movement of said rotatable body is limited by a stop.

15. The apparatus of claim 4 wherein a switching depression is disposed in said base body of said doctor blade bar and further including an ink circulation pump controlling limit switch secured to one of said doctor blade base support beams and having a pressure piece which is receivable in said switching depression, movement of said doctor blade bar causing said pressure piece to contact a surface of said switching depression and to actuate said ink circulation pump controlling limit switch.

16. The apparatus of claim 4 wherein said means to move said doctor blade bar are pneumatic work cylinders.

17. The apparatus of claim 4 wherein said first and second ribs have first and second wedge-shaped cross sections and further wherein said first and second ribs have different widths and the same height, said first and second wedge-shaped cross sections having first and second different ascending gradients, said first and second different ascending gradients causing said doctor blade bar to move in said first curved path upon actuation of said means to move said doctor blade.

18. The apparatus of claim 4 wherein said doctor blade includes a wear indicator.

19. Apparatus for the placement of a doctor blade supported in a doctor blade bar against an ink dispensing roller in a web-fed rotary printing press, said apparatus comprising:

at least a first doctor blade supporting base body forming a doctor blade bar;

at least a first doctor blade resiliently supported in said doctor blade bar at a negative placement angle with respect to an ink-dispensing roller;

means to move said doctor blade bar initially along a first path until a working end of said first doctor blade engages a jacket of an ink-dispensing roller at a first angle, and is pushed back into said doctor blade bar against a force of a biasing means, said first angle being generally perpendicular to a tangent line at a contact point of said working end of said first doctor blade with a jacket of an ink-dispensing roller, and to move said doctor blade bar subsequently along a second path generally along a jacket of an ink-dispensing roller to a working position of said doctor blade wherein said doctor blade is at a negative placement angle with regard to said tangent line;

transport edges provided on first portions of said doctor blade bar; and doctor blade base support beams having first and second ribs which are engageable with said transport edges when said doctor blade bar is moved by said means to initially and subsequently move said doctor blade bar, said means including a blade base shifting assembly secured to each of said doctor blade base support beams and having a rotatable body with two angled, fork shaped ends and wherein said rotatable body is rotatably seated in said doctor blade bar support beam by a dowel screw.-.

20. A method for placement of a doctor blade against an ink-dispensing roller in a web-fed rotary press, said method comprising:

providing at least a first doctor blade bar having at least a first doctor blade supporting base body;

resiliently supporting a first doctor blade in said doctor blade supporting base body;

moving said doctor blade bar initially along a first curved path of travel until a working end of said first doctor blade is engaging a jacket of an ink-dispensing roller at a first angle, and forcing said first doctor blade back into said doctor blade bar against a force of a biasing means, said first angle being generally perpendicular to a tangent line at a contact point of said working end of said first doctor blade with a jacket of an ink-dispensing roller, moving said doctor blade bar subsequently along a second path and moving said working end of said first doctor blade generally along a jacket of an ink dispensing roller to a working position of said doctor blade; and terminating said movement of said doctor blade bar along a jacket of an ink dispensing roller when said working doctor blade has taken up a negative placement angle against a jacket of an ink dispensing roller.

* * * * *